US008337669B2

(12) United States Patent
Pontén et al.

(10) Patent No.: US 8,337,669 B2
(45) **Date of Patent: *Dec. 25, 2012**

(54) APPARATUS FOR WASHING AND DEWATERING PULP

(75) Inventors: Fredrik Pontén, Sundsvall (SE); Johan Bylander, Sundsvall (SE); Jörgen Lundberg, Sundsvall (SE)

(73) Assignee: Metso Paper, Inc. (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/747,594

(22) PCT Filed: Dec. 11, 2008

(86) PCT No.: PCT/SE2008/051441

§ 371 (c)(1),
(2), (4) Date: Jun. 11, 2010

(87) PCT Pub. No.: WO2009/075643

PCT Pub. Date: Jun. 18, 2009

(65) Prior Publication Data

US 2010/0294708 A1 Nov. 25, 2010

(30) Foreign Application Priority Data

Dec. 13, 2007 (SE) ..... 0750012

(51) Int. Cl.
*D21F 1/00* (2006.01)

(52) U.S. Cl. ..... 162/301

(58) Field of Classification Search ..... 162/301, 162/303, 314, 322, 323, 329, 336; 210/236, 210/326, 386, 401; 100/120
See application file for complete search history.

(56) References Cited

U.S. PATENT DOCUMENTS

| | | | | |
|---|---|---|---|---|
| 3,772,144 | A | 11/1973 | Luthi et al. | |
| 3,980,518 | A | 9/1976 | Ljung et al. | |
| 5,488,900 | A | 2/1996 | Sundqvist | |
| 6,461,505 | B1 * | 10/2002 | Danielsson et al. | 210/248 |
| 6,660,161 | B2 * | 12/2003 | Danielsson et al. | 210/326 |
| 2010/0269997 | A1 * | 10/2010 | Bylander et al. | 162/358.3 |
| 2010/0276094 | A1 * | 11/2010 | Bylander et al. | 162/56 |
| 2011/0017646 | A1 * | 1/2011 | Bylander et al. | 210/88 |

FOREIGN PATENT DOCUMENTS

| | | | |
|---|---|---|---|
| EP | 1035250 | A2 | 9/2000 |
| SE | 380300 | B | 11/1975 |
| SE | 501710 | C2 | 5/1995 |
| SE | 501799 | C2 | 5/1995 |
| SE | 512753 | C2 | 5/2000 |

OTHER PUBLICATIONS

International Search Report, PCT/SE2008/051441, dated Mar. 11, 2009.

* cited by examiner

*Primary Examiner* — Mark Halpern
(74) *Attorney, Agent, or Firm* — Lerner, David, Littenberg, Krumholz & Mentlik, LLP

(57) ABSTRACT

Apparatus for washing and dewatering pulp comprising rotatable press rolls including permeable outer surfaces and a casing comprising a vat in which the rolls are installed are disclosed. A feed for feeding the pulp through the gap between the vat and the outer surfaces of the press rolls is provided and the vat includes a vat segment providing at least one compartment between the vat segment and the casing, the at least one compartment extending along the longitudinal extension of one of the first and second rotatable press rolls and a pressure device to maintain the pressure in the at least one compartment corresponding to the pressure in the gap.

12 Claims, 5 Drawing Sheets

APPARATUS FOR WASHING AND DEWATERING PULP

This application is a 371 of PCT/SE2008/051441 filed on 11 Dec. 2008

CROSS-REFERENCE TO RELATED APPLICATIONS

The present application is a national phase entry under 35 U.S.C. §371 of International Application No. PCT/SE2008/051441 filed Dec. 11, 2008, published in English, which claims priority from Swedish Patent Application No. 0750012-7 filed Dec. 13, 2007, all of which are incorporated herein by reference.

FIELD OF THE INVENTION

The present invention relates to apparatus for washing and dewatering pulp, especially cellulose-containing pulp, comprising first and a second rotatable press rolls having permeable outer surfaces, and a casing provided with a vat in which the press rolls are installed. The vat partly encloses the outer surface of each press roll and a gap is formed between the vat and the outer surfaces of the press rolls, and the vat comprises at least one vat segment. The press rolls define a press nip between them, in which press nip the pulp is pressed, and the apparatus is arranged to feed the pulp in the gap in the direction of rotation of the press rolls and through the press nip.

BACKGROUND OF THE INVENTION

When producing cellulose-based products, a roll press is frequently used for washing and dewatering the cellulose-based pulp. The pulp is passed between two cooperating press rolls installed in a vat included in a casing. The press rolls have a perforated outer surface, a so called mantle surface, whereby the outer surface is permeable to liquid pressed out of the pulp, and the pulp is pressed in the roll nip, or the press nip, between the press rolls, whereby liquid is pressed out of the pulp. The roll press also includes one or more washing zones prior to the press nip. One example of such a roll press is disclosed in U.S. Pat. No. 3,980,518, where the central axes of the press rolls lie in substantially the same horizontal plane. A gap is formed between the vat and the outer surface of the press rolls, and the pulp is fed in the gap in the direction of rotation of the press rolls and through the press nip.

The dimensions and weight of the vat and the casing, which includes the gable constructions of the apparatus, must be great so that the casing can withstand the great forces acting on the vat, which forces originate from the internal overpressure produced within the vat during operation.

The vat in which the two press rolls are installed and partially enclosed limits accessibility to the press roll, especially if the vat encloses a large portion of the circumference of the perforated outer surface of the press roll. Accessibility to the press roll is necessary for performing maintenance work, cleaning the press roll and the press nip, e.g. clearing plugs and removing pulp jammed on the perforated outer surface or in proximity to the press roll, or for changing press rolls. One way of providing accessibility to the press rolls and the press nip is to provide the roll press with pivotable vat segments, as disclosed in U.S. Pat. No. 3,980,518.

Pivotable vat segments are also disclosed in European Patent No. 1,035,250 which describes apparatus for washing and dewatering pulp comprising two filter drums arranged to rotate in opposite directions to create a press nip. A gap is formed between the vat and the outer surface of the filter drums, in which gap the pulp is fed while being pressed and washed. The filter drums are installed in a vat which comprises two pivotable upper vat segments for providing access to the filter drums. In European Patent No. 1,035,250, the pivotable vat segments are pivotally mounted to different beams which are mounted at respective longitudinal sides of the apparatus. These two beams are anchored to the ends of the casing or frame of the apparatus. The dimensions and weight of the beams, the pivotable vat segments, and the gable constructions of the apparatus, respectively, must be great so that the casing can withstand the great forces acting on the pivotable vat segments, which forces originate from the internal overpressure produced within the vat during operation.

Large and heavy constructions are expensive to produce, and difficult and expensive to transport and install.

One object of the present invention is thus to reduce the weight of an apparatus for washing and dewatering pulp.

SUMMARY OF THE INVENTION

In accordance with the present invention, this and other objects have now been realized by the invention of apparatus for washing and dewatering pulp comprising first and second rotatable press rolls including permeable outer surfaces, and a casing comprising a vat in which the first and second rotatable press rolls are installed, the vat partially enclosing the permeable outer surfaces of each of the first and second rotatable press rolls and forming a gap between the vat and the permeable outer surfaces of the first and second rotatable press rolls, the first and second rotatable press rolls being juxtaposed with each other to provide a press nip therebetween for pressing the pulp therein, feed means for feeding the pulp to the gap in the direction of rotation of the first and second rotatable press rolls towards the press nip, the vat comprising at least one vat segment providing at least one compartment between the at least one vat segment and the casing, the at least one compartment extending along the longitudinal extension of at least one of the first and second rotatable press rolls, and pressure means for maintaining the pressure in the at least one compartment corresponding to the pressure in the gap. In a preferred embodiment, the apparatus includes at least one passage between the at least one compartment and the gap for maintaining the pressure in the at least one compartment corresponding to the pressure in the gap.

In accordance with one embodiment of the apparatus of the present invention, the vat comprises a first side vat segment partially enclosing the permeable outer surface of the first rotatable press roll, a second side vat segment partially enclosing the permeable outer surface of the second rotatable press roll, and a central vat segment partially enclosing the permeable outer surfaces of the first and second rotatable press rolls between the press nip and the first and second side vat segments, and wherein the at least one compartment is provided between the central vat segment and the casing. In a preferred embodiment, the central vat segment includes a first end and a second end, the central vat segment extending along the longitudinal extension of at least one of the first and second rotatable press rolls between the first and second ends of the central vat segment, first mounting means for mounting the first end of the central vat segment to the casing, and second mounting means for mounting the second end of the central vat segments to the casing, the first mounting means comprising first guide means for guiding the first end of the central vat segment with respect to the first and second rotatable press rolls in the direction of the longitudinal extension of the at least one of the first and second rotatable press rolls. In a preferred embodiment, the first guide means is adapted to allow limited rotation of the first end of the central vat segment about an axis transverse to the longitudinal extension of the at least one of the first and second rotatable press rolls.

In accordance with one embodiment of the apparatus of the present invention, the first guide means comprises a plurality of complementary guide elements adapted to slide with respect to each other in the direction of the longitudinal direction of the at least one of the first and second rotatable press rolls, and at least one of the plurality of complementary guide elements being attached to the central vat segment, and at least one other of the complementary guide elements being attached to the casing, the at least one of the plurality of guide elements comprising a groove extending in the direction of the longitudinal extension of the at least one of the first and second rotatable press rolls and the at least one other of the guide elements comprising a projection engaging the groove.

In accordance with another embodiment of the apparatus of the present invention, the second mounting means comprises second guide means for guiding the second end of the central vat segment with respect to the first and second rotatable press rolls in the direction of the longitudinal extension of the other of the first and second rotatable press rolls. In a preferred embodiment, the second guide means is adapted to permit limited rotation of the second end of the central vat segment about an axis transverse to the longitudinal extension of the other of the first and second rotatable press rolls. In another embodiment, the first mounting means comprises a first guiding device to which the first guide means is attached, and the second mounting means comprises a second guiding device to which the second guide means is attached, the first and second guiding devices being adapted to move the central vat segment between a closed position adjacent to the press nip and an open position remote from the press nip for providing access to the first and second rotatable press rolls.

In accordance with another embodiment of the apparatus of the present invention, the casing comprises a first side casing member including the first side vat segment and a second side casing member including the second side vat segment, at least the first side casing member being pivotable about an axis of rotation and movable between a closed position and an open position for providing access to the first rotatable press roll in the open position, and the first side casing member including at least one support member for supporting the central vat segment when the first side casing member is in the closed position. In a preferred embodiment, the at least one support member is adapted to support the longitudinal edge of the central vat segment adjacent to the first side vat segment when the first side casing member is in the closed position.

In accordance with another embodiment of the apparatus of the present invention, the at least one support member is disposed along the longitudinal extension of the first and second rotatable press rolls.

In accordance with another embodiment of the apparatus of the present invention, the at least one compartment is provided between at least of the first and second side vat segments and the casing.

In accordance with another embodiment of the apparatus of the present invention, the vat comprises a first side vat segment partially enclosing the permeable outer surface of the first rotatable press roll, a second side vat segment partially enclosing the permeable outer surface of the second rotatable press roll, and a central vat segment partially enclosing the permeable outer surfaces of the first and second rotatable press rolls between the press nip and the first and second side vat segments, the at least one compartment being provided between at least one of the first and second side vat segments and the casing.

In accordance with the present invention, these objects of this invention are achieved by providing apparatus of the type defined in the specification, having the features that at least one compartment is provided between the at least one vat segment and the casing, the compartment extending along the longitudinal extension of at least one of the press rolls, and that the apparatus comprises means for attaining a pressure in the compartment which corresponds to the pressure in the gap.

By providing the same pressure on both sides of the vat segment, i.e. the side facing the gap and the side facing the casing, the deformation forces acting on the vat segment are reduced, and therefore, the vat segment can be manufactured using less material, providing a low weight vat segment. Further, the casing and various mounting elements can be manufactured using less material, since the forces acting on the casing, which forces are originating from the internal overpressure, are also reduced. The vat segment and other filtrate-exposed apparatus parts are made of an acid-resistant material, and acid-resistant materials are expensive. Thus, the cost for producing the vat segment and other apparatus parts is reduced, since less acid-resistant material is needed for producing the vat segment and the filtrate-exposed parts. Since the deformation forces are reduced, sealing means for sealing off the gap from the atmosphere, e.g. sealing means between movable casing members, can also now be less complicated, or even excluded at certain positions within the apparatus. Thus, by means of the present invention apparatus is provided which is easier to transport and install, and easier and less expensive to manufacture.

The vat can be composed of one or several vat segments. The vat, or the vat segments, is enclosed by the casing and the outer surface of the press rolls. The compartment forms a space between the vat segment and the casing, and can be in the form of a gap or a room. One or several compartments can be positioned between one vat segment and the casing. If several compartments are provided between one vat segment and the casing, these compartments can be positioned one after the other along the longitudinal extension of at least one of the press rolls, or one after the other in the direction of rotation of one of the press rolls.

The axes of rotation of the press rolls can be in substantially the same horizontal plane, or the axes of rotation of the press rolls can be positioned in other ways. The axes of rotation of the press rolls can, for example, be in substantially the same vertical plane.

According to an advantageous embodiment of the apparatus according to the present invention, the compartment and the gap are in communication with each other by means of at least one passage between the compartment and the gap, to attain a pressure in the compartment which corresponds to the pressure in the gap. In this manner, efficient and self-regulating means for attaining a pressure in the compartment which corresponds to the pressure in the gap are provided. However, other means for attaining said pressure in the compartment are possible, for example a pressure controlling device which actively controls the pressure in the compartment.

According to a further advantageous embodiment of the apparatus according to the present invention, the vat comprises a first side vat segment which partly encloses the outer surface of the first press roll, a second side vat segment which partly encloses the outer surface of the second press roll, and a central vat segment partially enclosing the outer surface of the press rolls between the press nip and the side vat segments, where the at least one compartment is provided between the central vat segment and the casing. In this manner, the central vat segment can be produced using less material, whereby a low-weight central vat segment is provided.

According to another advantageous embodiment of the apparatus according to the present invention, where at least one compartment is provided between the central vat segment and the casing, the central vat segment has a first end and a second end, between which ends the central vat segment extends along the longitudinal extension of at least one of the press rolls, and the apparatus comprises first mounting means for mounting the first end to the casing, and second mounting means for mounting the second end to the casing, where the first mounting means comprises first guiding means for guiding the first end in relation to the press rolls in the direction of the longitudinal extension of at least one of the press rolls. When the central vat segment is manufactured using less material, the plates building up the central vat segment are thinner compared to those in the prior art. Compared to thicker plates, these thinner plates are more sensitive to thermal changes, for example heating by the hot steam from the pulp in the gap and cooling when the apparatus is inoperative, as thinner plates are more quickly heated and cooled than thicker plates, and the rate at which the central vat segment thermally expands and thermally contracts, respectively, is thus increased in relation to thicker segments. Therefore, the dimensions of a thin central vat segment will vary to a greater extent and more quickly as compared to segments made of thicker material. By this embodiment, the central vat segment is allowed to thermally expand in the direction of the longitudinal extension of at least one of the press rolls, since one of the ends of the central vat segment can move in relation to the press rolls and the casing. Without this play in the axial direction, the mounting means of the central vat segment or the central vat segment would be deformed because of the thermal expansion of the central vat segment, resulting in a standstill because of replacement or repair, or there would be material fatigue with regard to the mounting means of the central vat segment or the central vat segment itself, resulting in later deformations. Since the length of the central vat segment in the direction of the longitudinal extension of at least one of the press rolls is much greater than the width of the central vat segment, the thermal expansion and contraction of the central vat segment because of thermal changes will be most prominent and significant in the axial direction, i.e. in the direction of the longitudinal extension of at least one of the press rolls.

According to still another advantageous embodiment of the apparatus according to the present invention, first guiding means are adapted to allow a limited rotation of the first end about an axis which is transverse to the longitudinal extension of at least one of the press rolls. In this manner, the central vat segment is allowed to curve along its longitudinal axis to a limited extent, which can be the case because of thermal expansion of the central vat segment.

According to yet another advantageous embodiment of the apparatus according to the present invention, the first guiding means comprise at least two complementary guiding elements adapted to slide in relation to each other in the direction of the longitudinal extension of at least one of the press rolls, one of the guiding elements being attached to the central vat segment, and the other guiding element being attached to the casing, where one of the guiding elements comprises a groove extending in the direction of the longitudinal extension of at least one the press rolls, and the other guiding element comprises a projection engaging the groove.

According to an advantageous embodiment of the apparatus according to the present invention, the second mounting means comprise second guiding means for preventing the movement of the second end in relation to the press rolls in the direction of the longitudinal extension of at least one of the press rolls. In this manner, dislocation of the central vat segment because of the thermal changes is restricted and efficiently controlled, whereby the general axial position of the central vat segment in relation to the press rolls can be substantially maintained, but still allowing for thermal expansion and contraction of the central vat segment.

According to still another advantageous embodiment of the apparatus according to the present invention, the second guiding means are adapted to allow a limited rotation of the second end about an axis which is transverse to the longitudinal extension of at least one of the press rolls. In this manner, the central vat segment is allowed to curve along its longitudinal axis to a limited extent, which can be the case because of thermal expansion of the central vat segment.

According to an advantageous embodiment of the apparatus according to the present invention, the first mounting means comprise a first guiding device to which the first guiding means is attached, and the second mounting means comprise a second guiding device to which the second guiding means is attached, and the guiding devices are adapted to move the central vat segment between a closed position adjacent to the press nip and an opened position remote from the press nip for providing access to the press rolls. In this manner, an efficient combination of the possibility to adjust the vertical position of the central vat segment and the freedom of the central vat segment to thermally expand and contract is attained.

Apparatus having the first and second mounting means, without being equipped with the means for attaining a pressure in the compartment which corresponds to the pressure in the gap, could also be provided.

According to a further advantageous embodiment of the apparatus according to the present invention, the casing comprises a first side casing member provided with the first side vat segment, and a second side casing member provided with the second side vat segment, at least the first side casing member being pivotable about an axis of rotation and movable between a closed position and an opened position for providing access to the first press roll, and the first side casing member is provided with one or several support members for supporting the central vat segment, when the first side casing member is in the closed position. In this manner, additional support for the central vat segment is provided, whereby the central vat segment can be manufactured using even less material. Further, the support members also function as positioning means for the central vat segment, whereby the support members provide for the central vat segment being positioned and maintained in a correct vertical position in relation to the side vat segments. Any deformation of the central vat segment resulting from the weight of the vat segment and the internal pressure in the gap is also prevented by the support members. Advantageously, the one or several support members are adapted to support a longitudinal edge of the central vat segment, which longitudinal edge is adjacent to the first side vat segment, when the first side casing member is in the closed position. Advantageously, several support members are distributed one after the other along the longitudinal extension of the first press roll and spaced apart. Alternatively, one support member could be provided extending along the entire longitudinal extension of the central vat segment or several support members can be distributed along the longitudinal extension of the central vat segment. Alternatively, the support members can be pivotally attached to the side casing member, and adapted to be moved between an operative external position in relation to the side casing member and an inoperative position.

Apparatus having the support members, without being equipped with the means for attaining a pressure in the compartment which corresponds to the pressure in the gap and/or the first and second mounting means, could also be provided.

According to a further advantageous embodiment of the apparatus according to the present invention, at least one compartment is provided between at least one of the side vat segments and the casing. When the casing comprises pivotable side casing members, the compartment is provided between the side vat segment and the side casing member. In this manner, a casing including pivotable side casing members can be manufactured using less material. The mounting means providing the pivotability of the side casing members can also be manufactured using less material, since they need not to be as strong as in prior art apparatus. Advantageously, at least one compartment is provided between both side vat segments and the casing. In this manner, the forces acting on the side casing members are further balanced, whereby the side casing members can be manufactured using even less material, providing pivotable side casing members of reduced weight, but still capable of efficiently withstanding the forces acting on the side casing members.

Further advantageous embodiments of the apparatus according to the present invention emerge from the detailed description of preferred embodiments.

BRIEF DESCRIPTION OF THE DRAWINGS

The present invention will now be described, for exemplary purposes, in more detail by reference to the following detailed description which refers to the enclosed drawings, in which.

DETAILED DESCRIPTION

Figure 1A:
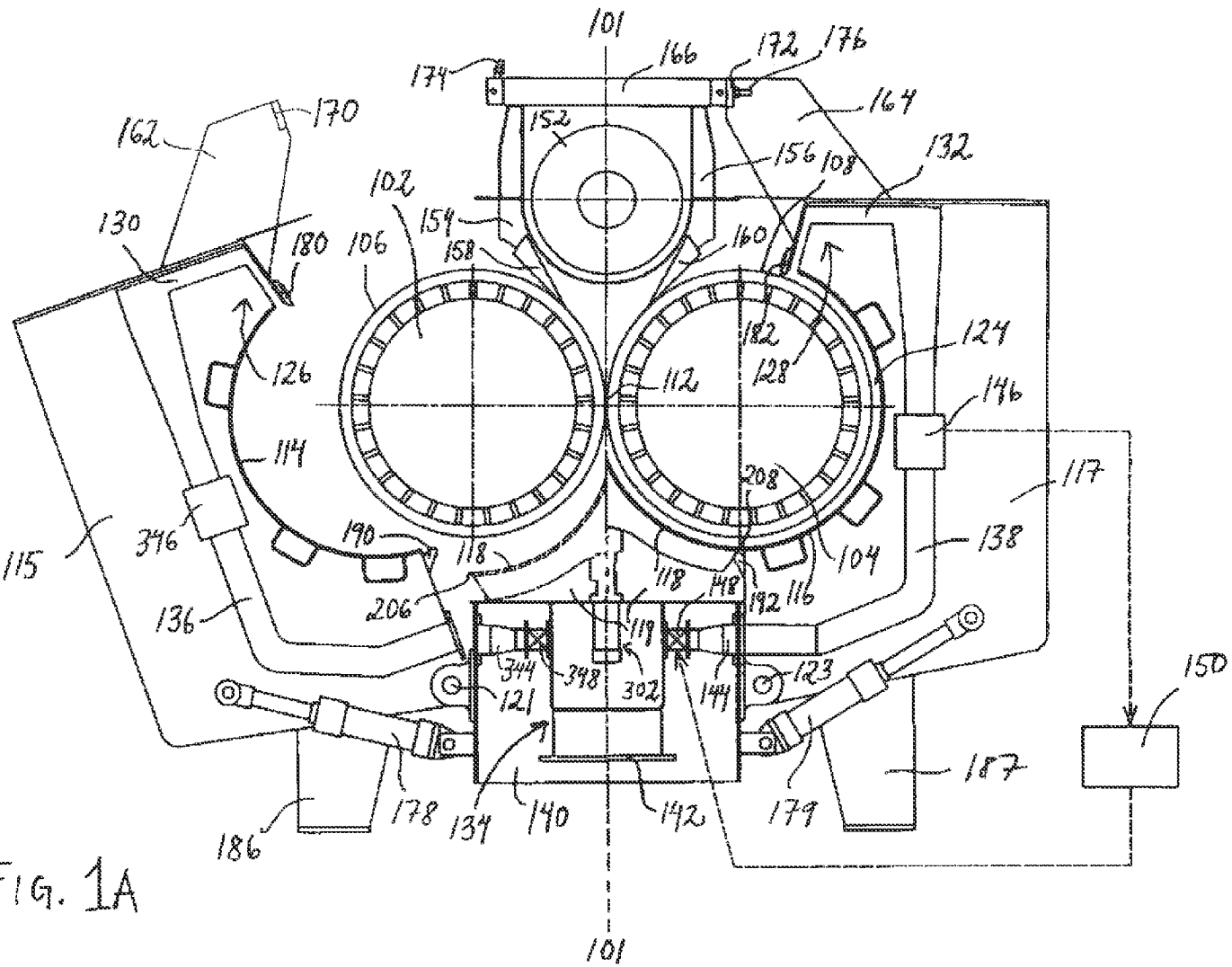
FIG. 1A is a side, electrical, schematic view of an embodiment of the apparatus according to the present invention.

FIG. 1A shows an embodiment of the apparatus for washing and dewatering cellulose-containing pulp according to the present invention. The apparatus has a substantially symmetrical configuration with regard to a symmetry plane 101, and in FIG. 1A, the left side of the apparatus, i.e. to the left of the symmetry plane 101, illustrates the apparatus in an opened position, whereas the right side of the apparatus, i.e. to the right of the symmetry plane 101, illustrates the apparatus in a closed and operating position. The apparatus comprises a first rotatable press roll 102 on the left side of the apparatus and a second rotatable press roll 104 on the right side of the apparatus, each press roll, 102 and 104, having a permeable outer surface, 106 and 108. The outer surfaces, 106 and 108, are perforated, i.e. provided with apertures, whereby the outer surface, 106 and 108, is permeable to filtrate pressed out of the pulp. The shape of the apertures is normally circular, but any shape is possible. The press rolls, 102 and 104, comprise a number of filtrate channels 110 radially inwards of the outer surface, 106 and 108, to lead evacuated filtrate away. The two press rolls defines a press nip 112 between them, in which press nip the pulp is pressed, and are arranged to rotate in opposite directions, the left press roll 102 being arranged to rotate in a counter-clockwise direction and the right press roll 104 being arranged to rotate in a clockwise direction. In this embodiment, the axes of rotation of the press rolls, 102 and 104, are in substantially the same horizontal plane, and the apparatus is arranged to feed the pulp through the press nip 112 in a substantially vertical direction from below upwards. However, other positions of the press rolls, 102 and 104, in relation to each other are possible, and the pulp can be fed through the press nip 112 in other directions. The press rolls, 102 and 104, are adjustable in relation to each other, whereby the press nip 112 is adjustable.

The apparatus comprises a casing which includes a vat, 114, 116, and 118, in which the press rolls, 102 and 104, are installed, the vat, 114, 116, and 118, partly enclosing the outer surface, 106 and 108, of each press rolls, 102 and 104, whereby a gap 124 for each press roll, 102 and 104, is defined, limited by the vat, 114, 116, and 118, and the outer surface, 106 and 108, of the respective press roll, 102 and 104. The vat, 114, 116, and 118, is built up of a first side vat segment 114 which partly encloses the outer surface 106 of the first press roll 102, a second side vat segment 116 which partly encloses the outer surface 108 of the second press roll 104, and a central vat segment 118 partly enclosing the outer surfaces, 106 and 108, of the press rolls, 102 and 104, between the press nip 112 and the side vat segments, 114 and 116. The central vat segment 118 is movable in a substantially vertical direction for providing additional accessibility to the region in proximity to the press nip 112. In FIG. 1A, on the left side of the apparatus, the central vat segment 118 is shown in an inoperative opened position, whereas on the right side of the apparatus, the central vat segment 118 is shown in an operative closed position.

As mentioned above, a gap 124 is formed between the vat, 114, 116, and 118, and the outer surface, 106 and 108 of the press rolls, 102 and 104. In FIG. 1A, only the right side of the apparatus illustrates the apparatus in a closed and operating position, and thus, only the gap 124 with regard to the second press roll 104 and the vat, 116 and 118, is shown, whereas the gap with regard to the first press roll 102 and the vat, 114 and 118, is not present in FIG. 1A. However, when the left side of the apparatus is in a corresponding closed and operating position, a corresponding gap is provided between the first press roll 102 and the vat, 114 and 118.

The casing comprises a first side casing member 115 which extends between the ends of the first press roll 102 and to which the first side vat segment 114 is mounted, and a second side casing member 117 which extends between the ends of the second press roll 104 and to which the second side vat segment 116 is mounted. The side vat segment, 114 and 116, can be mounted to the side casing member 115, 117 in different ways, or the side vat segment, 114 and 116, can be integrally formed with its side casing member, 115 and 117. The side casing members, 115 and 117, together with their side vat segments, 114 and 116, are pivotable about an axle, 121 and 123, forming an axis of rotation, 121 and 123, and movable between a closed position and an opened position for providing access to the press rolls, 102 and 104. In FIG. 1A, on the left side of the apparatus, the first side casing member 115 is in the opened position, whereby access to the press roll 102 is provided, whereas on the right side of the apparatus, the second side casing member 117 is in the closed position.

Further, the casing includes a central casing member 140, in the form of a stationary base unit 140 positioned substantially below the first and second press rolls, 102 and 104, a stationary first end casing member 210 in the form of a first gable, and a stationary second end casing member 212 in the form of a second gable (the end casing members, 210 and 212, being shown in FIG. 2B). The press rolls, 102 and 104, are pivotally mounted to the end casing members, 210 and 212, and the central casing member 140 is mounted to the end casing members, 210 and 212. Each side casing member, 115 and 117, is pivotally attached to the central casing member 140, and each side casing member, 115 and 117, is also connected to the central casing member 140 by means of a respective hydraulic cylinder, 178 and 179, for controlling the movement of the respective side casing member, 115 and 117. The central vat segment 118 is mounted to the central casing member 140 by means of mounting means which will be described in connection with FIGS. 3-5.

In operation, the central vat segment 118 is internal in relation to the casing formed by the above-mentioned casing members, 115, 117, and 140. Sealing means are provided between the each movable side casing member, 115 and 117, and the central casing member 140, and between each movable side casing member, 115 and 117, and the end casing members, 210 and 212. Further, a sealing member, 180 and 182, is mounted to each side casing member, 115 and 117, which sealing member, 180 and 182, extends along to the longitudinal extension of the press roll, 102 and 104, and is adapted to abut the outer surface, 106 and 108, of the press roll, 102 and 104, when the side casing member, 115 and 117, is in its closed position. As the sealing means, the sealing members, 180 and 182, are adapted to seal off the gap 124 from the external surroundings, i.e. the atmosphere, at the position where the pulp is distributed to the gap 124. The sealing member, 180 and 182, is in the form of a scraper. Thus, by way of the above-mentioned sealing means and sealing members, 180 and 182, the gap 124 and the surfaces defining the gap are sealed off from the atmosphere.

The apparatus comprises a first pulp distribution device 126 for distributing pulp on the first press roll 102 and a second pulp distribution device 128 for distributing pulp on the second press roll 104. The pulp distribution devices, 126 and 128, are arranged to distribute pulp to the gap 124 along the whole length of each press roll, 102 and 104. The pulp distributed on the outer surface, 106 and 108, of the press roll, 102 and 104, forms a mat on the press rolls, 102 and 104. From the pulp distribution devices, 126 and 128, to the press nip 112, the pulp is fed in the gap 124 in the direction of rotation of the press rolls, 102 and 104, while being pressed, or pressed and washed.

The first pulp distribution device 126 is mounted on the first side casing member 115, and the second pulp distribution device 128 is mounted on the second side casing member 117. In this manner, the pulp distribution device, 126 and 128, comprise a forming unit, 130 and 132, for forming the pulp prior to distribution on the press roll, 102 and 104. However, other kinds of pulp distribution devices are possible, such as pulp distribution screws etc. The pulp distribution device, 126 and 128, can also comprise several separate pulp distribution units distributed one after the other along the longitudinal extension of the press roll, 102 and 104.

The apparatus rests on the ground via four legs, 186, 187, 188, and 189, (only two legs are shown in FIG. 1A).

Figure 1B:
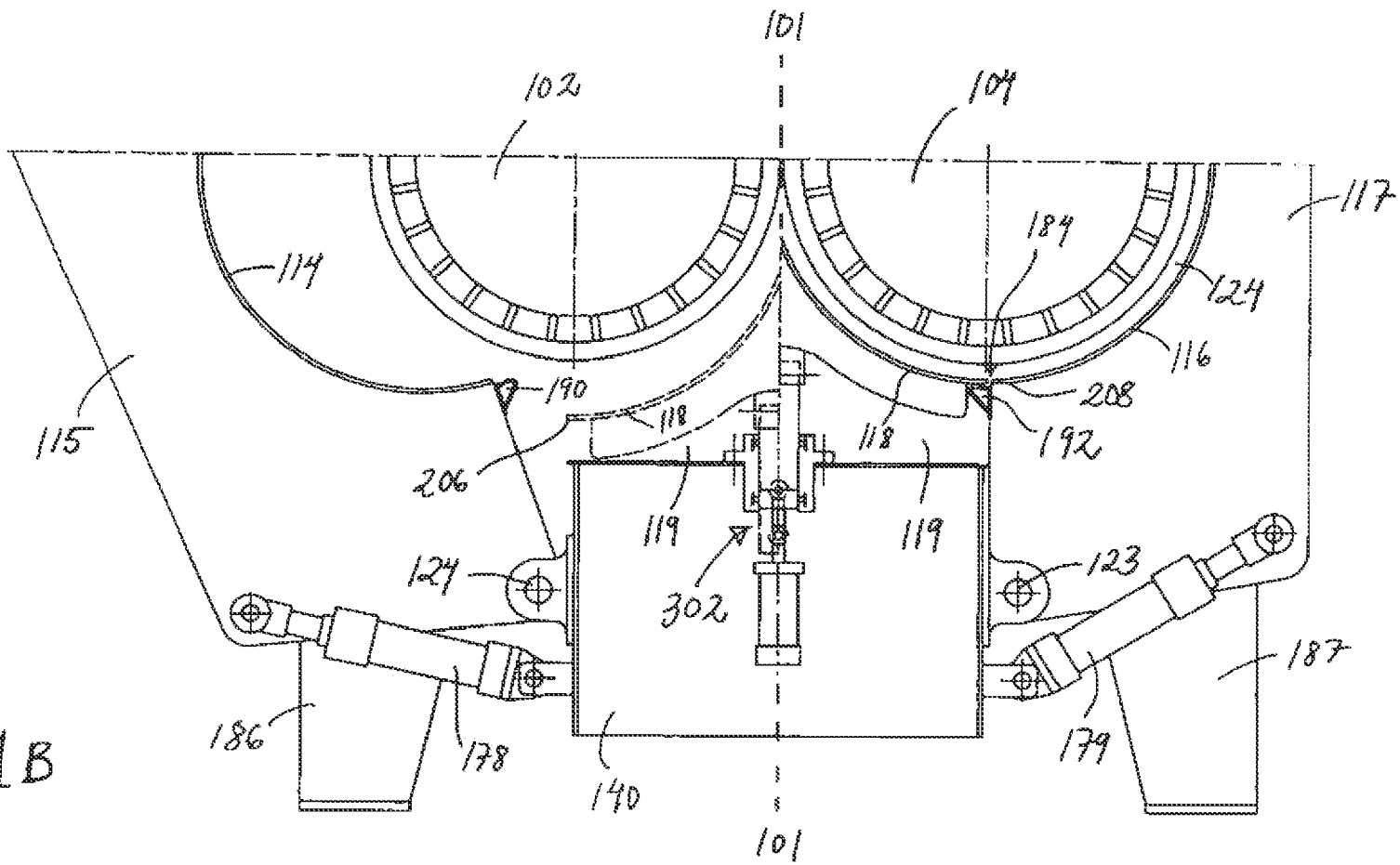
FIG. 1B is a partial, side, integral elevational view of the lower part of the apparatus shown in FIG. 1A.

FIG. 1B is a schematic enlargement of the lower part of the apparatus of FIG. 1A. Between the central vat segment 118 and the central casing member 140, a space in the form of a compartment 119 is provided, which compartment 119 extends along the longitudinal extension of the press rolls, 102 and 104. The apparatus includes means for attaining a pressure in the compartment 119 which corresponds to the pressure in the gap 124, which means are adapted to attain a pressure in the compartment 119 which is substantially equal to the pressure in the gap 124. The means are in the form of passages, 84, 85, 184, and 185, between the compartment 119 and the gap 124, whereby the compartment 119 and the gap 124 are in communication with each other in order to attain substantially the same pressure in the compartment as in the gap 124. By providing substantially equal pressure on both sides of the central vat segment 118, .e. the side facing the gap and the side facing the casing, the central vat segment 118 is subjected to less deformation forces, and can thus be manufactured using less material. The compartment 119 and the gap 124 are sealed off from the atmosphere by means of the above-mentioned casing members, 115, 117, and 140, and the above-mentioned sealing members, 180 and 182, and sealing means.

Figure 2A:
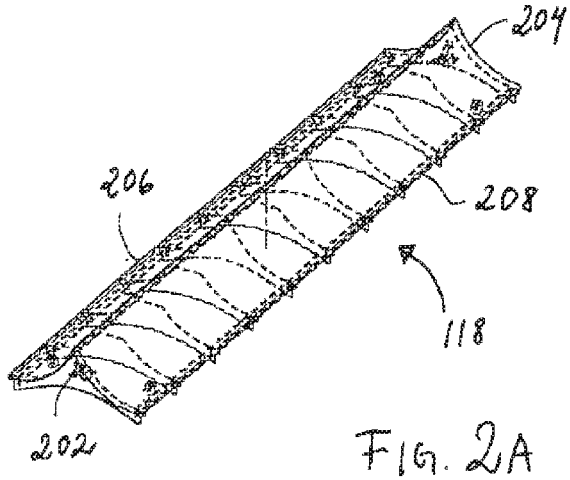
FIG. 2A is a side, schematic perspective view illustrating a design of the central vat segment of the embodiment shown in FIG. 1A.

FIG. 2A shows an embodiment of the central vat segment 118 where the surface adjacent to the gap 124 is in the form of a thin plate. The central vat segment 118 has a first end 202 and a second end 204, between which ends, 202 and 204, the longitudinal edges, 206 and 208, of the central vat segment 118 extend. The longitudinal edges, 206 and 208, extend along the longitudinal extension of the press rolls, 102 and 104.

Referring again to FIG. 1B, in order to further support the central vat segment 118, several support members, 190 and 192, are attached to the side casing members, 115 and 117. Thus, the support members, 190 and 192, are moved away from the central vat segment 118 together with the side casing members, 115 and 117, when these are moved to their opened position. The support members, 190 and 192, are adapted to support the longitudinal edges, 206 and 208, of the central vat segment 118, when the side casing members, 115 and 117, are in the closed position. One longitudinal edge 206 is adjacent to the first side vat segments 114 and the other longitudinal edge 208 is adjacent to the second side vat segment 116. The support members, 190 and 192, are distributed one after the other along the longitudinal extension of the press rolls 102, 104.

Figure 2B:
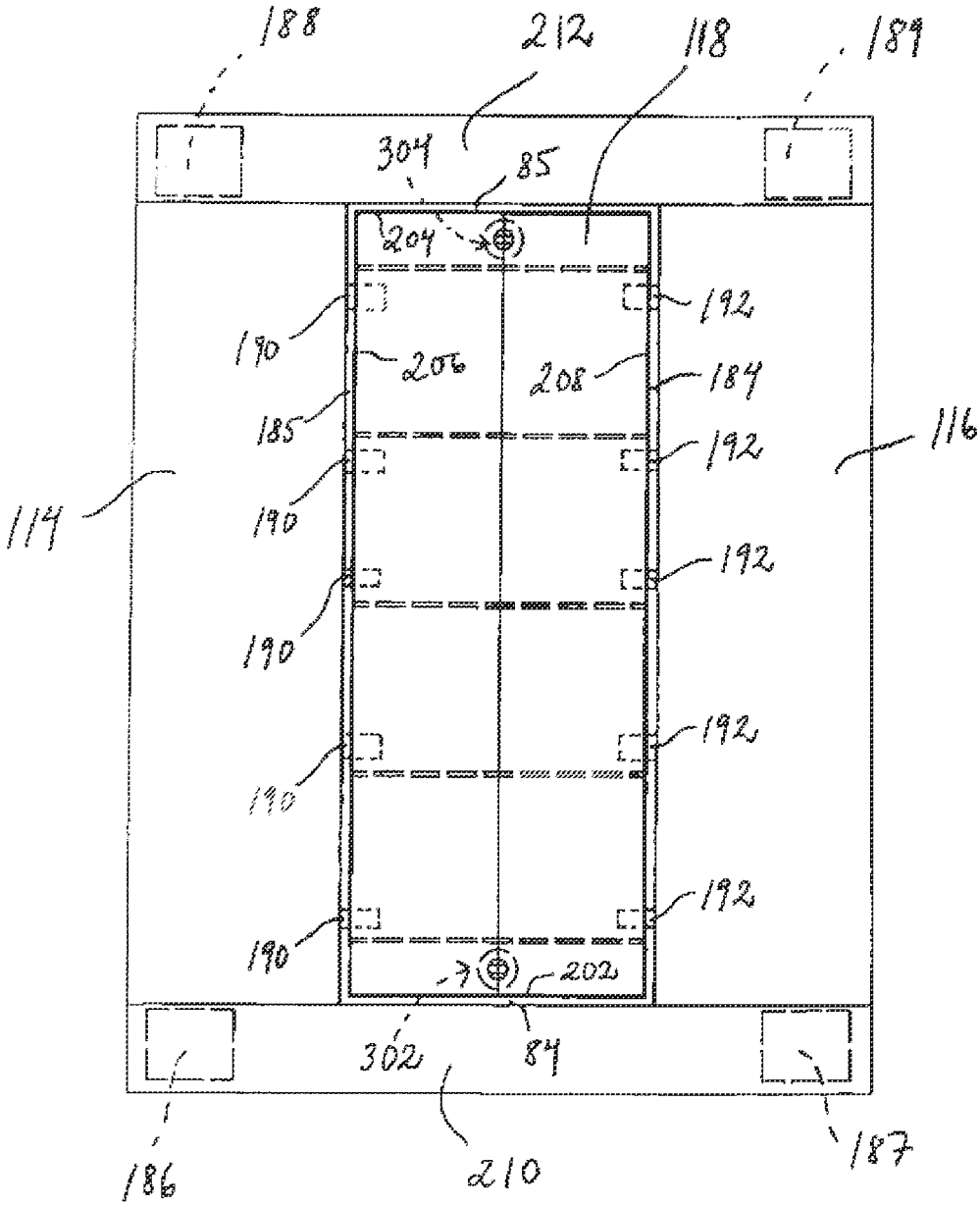
FIG. 2B is a top, elevational view of the central vat segment shown in FIG. 2A installed in the apparatus.

FIG. 2B shows the central vat segment 118 of FIG. 2A installed in the apparatus as viewed from above with the press rolls excluded. In FIG. 2B, the end casing members, 210 and 212, of the casing are shown. As mentioned above, the compartment 119 and the gap 124 are in communication with each other by means of passages, 84, 85, 184, and 185, which are in the form of longitudinal openings, 184 and 185, extending along the longitudinal edges, 206 and 208, of the central vat segment 118, and transverse openings, 84 and 85, extending along the ends, 202 and 204, of the central vat segment 118. The longitudinal openings, 184 and 185, are provided between the central vat segment 118 and the side vat segments, 114 and 116, when the side casing members, 115 and 117, are in the closed position. The transverse openings, 84 and 85, are provided between the central vat segment 118 and the end casing members, 210 and 212.

If compartments were provided between the side vat segments, 114 and 116, and the side casing members, 115 and 117, the longitudinal openings, 184 and 185, could form passages for the pressure communication between these compartments and the gap 124.

Further, FIG. 2B shows how the support members, 190 and 192, of each side casing members, 115 and 117, are spaced apart and distributed one after the other along the longitudinal extension of the press rolls, 102 and 104, and support the longitudinal edges, 206 and 208, of the central vat segment 118. The space between the support members, 190 and 192, should be sufficiently large so that enough space for the longitudinal openings, 184 and 185, for pressure communication is provided.

Figure 3:
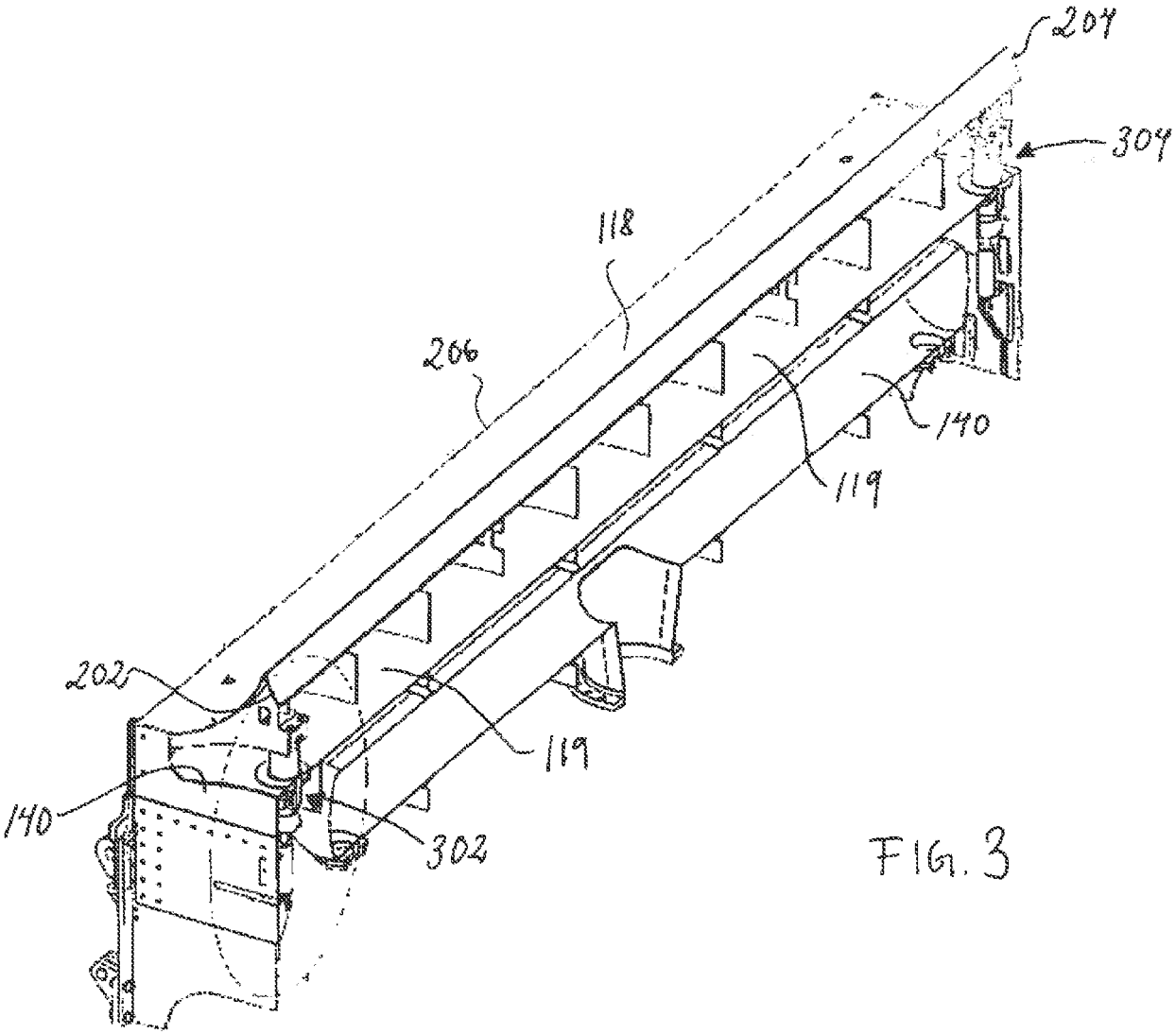
FIG. 3 is a side, schematic cross-sectional, perspective view of the mounting of the central vat segment of the embodiment shown in FIG. 1A.

FIG. 3 is a cut-away view showing the central vat segment 118 mounted to the central casing member 140. First mounting means 302 are provided for mounting the first end 202 of the central vat segment 118 to the central casing member 140, and second mounting means 304 are provided for mounting the second end 204 of the central vat segment 118 to the central casing member 140. The mounting means, 302 and 304, are attached to the central vat segment 118 adjacent to the central axis of the central vat segment 118, which further allows the dimensions of the central vat segment 118 to change due to thermal contraction and expansion of the central vat segment. If the central vat segment instead were attached to the casing at four points, for example at each corner, the thermal contraction and expansion of the central vat segment would be restricted.

Figure 4:
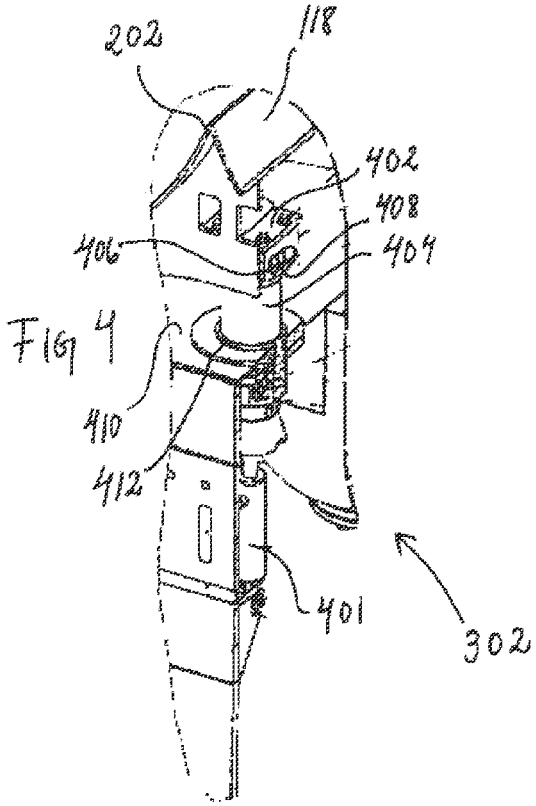
FIG. 4 is a front, partial, schematic perspective view of the first mounting means of the embodiment shown in FIG. 3.
Figure 5:
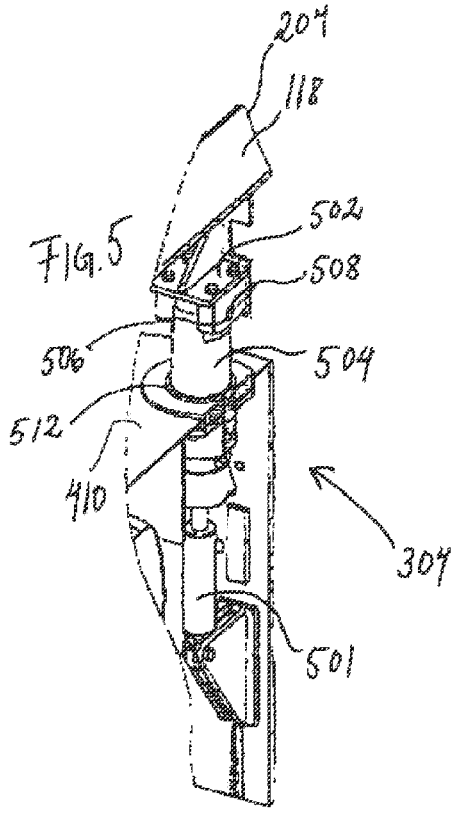
FIG. 5 is a front, partial, schematic, perspective view of the second mounting means of the embodiment shown in FIG. 3.

FIG. 4 is an enlargement of the first mounting means 302 and FIG. 5 is an enlargement of the second mounting means 304.

The first mounting means 302 include first guiding means for guiding the first end 202 of the central vat segment 118 in relation to the press rolls, 102 and 104, and the casing, in the direction of the longitudinal extension of the press rolls, 102 and 104, and a first guiding device 401, in the form of a hydraulic driving device. The first guiding means include a first guiding member 402 attached to first end 202 of the central vat segment 118 and a second guiding member 404 attached to the first guiding device 401. The first guiding member 402 is provided with two opposite grooves 406 (only one shown) extending in the direction of the longitudinal extension of the press rolls, 102 and 104, and the second guiding member 404 is provided with two projections 408 (only one shown) projecting in opposite directions, which engage the grooves 406 and are adapted to slide along the grooves 406. The grooves 406 and projections 408 are adapted to prevent the projections 408 and grooves 406 from moving in relation to each other in a substantially vertical direction. The first guiding means are adapted to allow a limited rotation of the first end 202 about an axis which is transverse to the longitudinal extension of the press rolls, 102 and 104, however a lateral movement of the first end 202 in the horizontal plane in relation to the press rolls, 102 and 104, is prevented by the first guiding means. Between the second guiding member 404 and an opening in a wall 410 of the compartment 119, in which opening the second guiding member 404 is inserted, sealing means 412 are provided.

The second mounting means 304 include second guiding means for preventing the movement of the second end 204 in relation to the press rolls, 102 and 104, in the direction of the longitudinal extension of the press rolls, 102 and 104, and a second guiding device 501, in the form of a hydraulic driving device. The second guiding means include a first guiding member 502 attached to second end 204 of the central vat segment 118 and a second guiding member 504 attached to the second guiding device 501. In this manner, the first guiding member 502 is provided with two opposite recesses 506 (only one shown) having a substantially circular cross-section, and the second guiding member 504 is provided with two projections 508 (only one shown) projecting in opposite directions, which snugly engage the recesses 506. The recesses 506 are adapted to rotate in relation to the projections 508, whereby the second guiding means are adapted to allow a limited rotation of the second end 204 about an axis which is transverse to the longitudinal extension of the press rolls, 102 and 104. However, a lateral movement of the second end 204 in the horizontal plane in relation to the press rolls, 102 and 104, is prevented by the second guiding means. Between the second guiding member 504 and an opening in the wall 410 of the compartment 119, in which opening the second guiding member 504 is inserted, sealing means 512 are provided.

Each guiding device, 401 and 501, is adapted to drive the respective cylindrical second guiding members, 404 and 504, and move it in the direction of its longitudinal axis in a substantially vertical direction between an elevated first position and a lowered second position. Thus, by means of the second guiding members, 404 and 504, the guiding devices, 401 and 501, are adapted to move the central vat segment 118 between the operative closed position adjacent to the press nip 112 and the inoperative opened position remote to the press nip 112 for providing access to the press rolls, 102 and 104.

By way of the first and second mounting means, 302 and 304, the central vat segment 118 is allowed to thermally contract and expand, especially in the direction of the longitudinal extension of the press rolls, 102 and 104, since the first end 202 of the central vat segment 118 is movable in relation to the press rolls, 102 and 104.

Further, the apparatus is provided with an inlet device 134 for receiving pulp to the apparatus, and several flow channels, 136 and 138, for transporting pulp from the inlet device 134 to the pulp distribution devices, 126 and 128, which flow channels, 136 and 138, are mounted to and integrated with the side casing members, 115 and 117. The inlet device 134 is housed in the central casing member 140. The inlet device includes an inlet 142 for connection to an external pulp supply, and an outlet means 144 for each flow channel, 136 and 138, which outlet means 144 is located in central casing member 140 and is connectable to its flow channel 138 when the side casing member 117 is in a closed position. The apparatus has sealing means for sealing the passage, from the outlet means 144 to the flow channel 138, between the outlet means 144 and the flow channel 138. The apparatus is provided with a flow meter 146 for measuring the flow rate of the pulp flow in the flow channel 138, and the outlet means 144 comprises a valve 148 for controlling the flow of pulp to the flow channel 138. The apparatus comprises a control device 150 for controlling the valve 148 based on the input of the flow meter 146.

The apparatus also includes a pulp transport screw 152, which for example can be in the form of a pulp disintegrating screw or a shredder screw, towards which the pulp which has been pressed in the press nip 112 is conveyed. The pulp transport screw 152 extends parallelly to the longitudinal axis of one of the press rolls, 102 and 104, and is arranged to disintegrate the pulp and transport the pulp axially away from the press for further processing. Each press roll, 102 and 104, is provided with a respective doctor bar, 154 and 156, and each doctor bar, 154 and 156, is provided at the bottom thereof with a respective doctor blade, 158 and 160, for scraping the outer surface, 106 and 108, of the respective press roll, 102 and 104.

The apparatus comprises two sets of arms, 162 and 164 (only one set shown in FIG. 1A). Each set comprising a first arm 162 and a second arm 164, where the first side casing member 115 is provided with the first arm 162 and the second side casing member 117 is provided with the second arm 164.

Each arm, 162 and 164, is provided with a locking means, 170 and 172, in the form of a recess, adapted to be detachably attached to a complementary locking means, 174 and 176, in the form of a bolt, for locking the side casing member, 115 and 117, in its closed position. The complementary locking means, 174 and 176, are pivotally anchored to a stationary central member 166 of the apparatus, which central member 166 is positioned above the press rolls, 102 and 104.

In the prior art, hydraulically driven guiding devices for movably mounting the central vat segment to the casing are directly attached to the central vat segment, and thus subjected to substantially all forces originating from the forces acting on the central vat segment. In order to withstand these forces, a prior art central vat segment is therefore mounted to the casing by four mounting means, in the form of hydraulically driven guiding devices. By the innovative mounting means, 302 and 304, of the present invention, stronger mounting of the central vat segment is provided. Since the mounting means, 302 and 304, provides an intermediate guiding member, 404 and 504, which connects the guiding device, 401 and 501, to the central vat segment 118, which guiding member, 404 and 504, is adapted to take up the horizontal force components originating from the forces acting on the central vat segment 118, the guiding device, 401 and 501, is essentially not subjected to any horizontal force components. Because of this intermediate guiding member, 404 and 504, adapted to withstand said horizontal component forces, the number of mounting means for mounting the central vat segment to the central casing member can be reduced to only two, whereby material is saved and a less complicated construction of the mounting of the central vat segment to the casing is provided.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for washing and dewatering pulp comprising first and second rotatable press rolls including permeable outer surfaces, and a casing comprising a vat in which said first and second rotatable press rolls are installed, said vat partially enclosing said permeable outer surfaces of each of said first and second rotatable press rolls and forming a gap between said vat and said permeable outer surfaces of said first and second rotatable press rolls, said first and second rotatable press rolls being juxtaposed with each other to provide a press nip therebetween for pressing said pulp therein, feed means for feeding said pulp to said gap in the direction of rotation of said first and second rotatable press rolls towards said press nip, said vat comprising at least one vat segment including a first side vat segment partially enclosing said permeable outer surface of said first rotatable press roll, a second side vat segment partially enclosing said permeable outer surface of said second rotatable press roll, and a central vat segment partially enclosing said permeable outer surface of said first and second rotatable press rolls between said press nip and said first and second side vat segments, thereby providing at least one compartment between said central vat segment and said casing, said casing comprising a first side casing member including said first side vat segment and a second side casing member including said second side vat segment, at least said first side casing member being pivotable about an axis of rotation and movable between a closed position and an open position providing access to said first rotatable press roll in said open position, and said first side casing member including at least one support member for supporting said central vat segment when said first side casing member is in said closed position, and pressure equalization means for equalizing the pressure between said at least one compartment and the pressure in said gap.

2. Apparatus according to claim 1 wherein said pressure equalization means includes at least one passage between said at least one compartment and said gap.

3. Apparatus according to claim 1 wherein said central vat segment includes a first end and a second end, said central vat segment extending along the longitudinal extension of at least one of said first and second rotatable press rolls between said first and second ends of said central vat segment, first mounting means for mounting said first end of said central vat segment to said casing, and second mounting means for mounting said second end of said central vat segments to said casing, said first mounting means comprising first guide means for guiding said first end of said central vat segment with respect to said first and second rotatable press rolls in the direction of said longitudinal extension of said at least one of said first and second rotatable press rolls.

4. Apparatus according to claim 3 wherein said first guide means is adapted to allow limited rotation of said first end of said central vat segment about an axis transverse to the longitudinal extension of said at least one of said first and second rotatable press rolls.

5. Apparatus according to claim 3 wherein said first guide means comprises a plurality of complementary guide elements adapted to slide with respect to each other in the direction of said longitudinal direction of said at least one of said first and second rotatable press rolls, at least one of said plurality of complementary guide elements being attached to said central vat segment, and at least one other of said complementary guide elements being attached to said casing, said at least one of said plurality of guide elements comprising a groove extending in the direction of said longitudinal extension of said at least one of said first and second rotatable press rolls and said at least one other of said guide elements comprising a projection engaging said groove.

6. Apparatus according to claim 3 wherein said second mounting means comprises second guide means for preventing movement of said second end of said central vat segment with respect to said first and second rotatable press rolls in the direction of said longitudinal extension of the other of said first and second rotatable press rolls.

7. Apparatus according to claim 6 wherein said second guide means is adapted to permit limited rotation of said second end of said central vat segment about an axis transverse to said longitudinal extension of said other of said first and second rotatable press rolls.

8. Apparatus according to claim 6 wherein said first mounting means comprises a first guiding device to which said first guide means is attached, and said second mounting means comprising a second guiding device to which said second guide means is attached, said first and second guiding devices being adapted to move said central vat segment between a closed position adjacent to said press nip and an open position remote from said press nip for providing access to said first and second rotatable press rolls.

9. Apparatus according to claim 1 wherein said at least one support member is adapted to support the longitudinal edge of said central vat segment adjacent to said first side vat segment when said first side casing member is in said closed position.

10. Apparatus according to claim 1 wherein said at least one support member is disposed along said longitudinal extension of said first and second rotatable press rolls.

11. Apparatus according to claim 1 wherein said at least one compartment is provided between at least one of said first and second side vat segments and said casing.

12. Apparatus according to claim 1 wherein said vat comprises a first side vat segment partially enclosing said permeable outer surface of said first rotatable press roll, a second side vat segment partially enclosing said permeable outer surface of said second rotatable press roll, and a central vat segment partially enclosing said permeable outer surfaces of said first and second rotatable press rolls between said press nip and said first and second side vat segments, said at least one compartment being provided between at least one of said first and second side vat segments and said casing.

* * * * *